US005617953A

United States Patent [19]

Cope

[11] Patent Number: 5,617,953

[45] Date of Patent: Apr. 8, 1997

[54] STACKABLE/NESTABLE CONTAINERS

[75] Inventor: Andrew C. Cope, Wednesbury, United Kingdom

[73] Assignee: McKechnie UK Limited, West Midlands, United Kingdom

[21] Appl. No.: 399,129

[22] Filed: Mar. 6, 1995

[30] Foreign Application Priority Data

Mar. 12, 1994 [GB] United Kingdom ..... 9404833

[51] Int. Cl.[6] ..... B65D 21/00

[52] U.S. Cl. ..... 206/501; 206/504; 206/505; 206/507; 220/23.4; 220/23.6; 220/23.86

[58] Field of Search ..... 206/501, 504, 206/505, 507; 220/23.4, 23.6, 23.83, 23.86

[56] References Cited

U.S. PATENT DOCUMENTS

| | | | |
|---|---|---|---|
| 1,575,906 | 3/1926 | Frey | 206/501 X |
| 3,117,692 | 1/1964 | Carpenter et al. | 206/501 X |
| 3,498,494 | 3/1970 | Voorhees, Jr. et al. . | |
| 3,659,743 | 5/1972 | Box | 206/504 |
| 4,105,117 | 8/1978 | Atkin et al. . | |
| 4,343,400 | 8/1982 | Faucillon | 206/507 |
| 4,863,222 | 9/1989 | Posso | 206/504 X |
| 4,919,267 | 4/1990 | Stoll | 206/507 |

FOREIGN PATENT DOCUMENTS

| | | | |
|---|---|---|---|
| 0579158A1 | 1/1994 | European Pat. Off. . | |
| 2617803 | 7/1987 | France . | |
| 1181119 | 11/1964 | Germany | 206/501 |
| 2728735 | 1/1979 | Germany | 206/501 |
| 668404A5 | 12/1988 | Switzerland . | |
| 1203403 | 8/1970 | United Kingdom . | |
| 1593581 | 7/1981 | United Kingdom . | |
| 2136399 | 9/1984 | United Kingdom . | |
| 2275254 | 8/1994 | United Kingdom . | |

*Primary Examiner*—Stephen K. Cronin
*Attorney, Agent, or Firm*—W. Thad Adams, III, P.A.

[57] ABSTRACT

A stack of containers is formed from a container system. The system includes a plurality of open-topped containers each adapted to be selectively stackable or nestable with like containers. First containers are of relatively large plan. Second containers are of smaller plan. Thus, large containers can stack or nest with large containers. Small containers can stack or nest with small containers. Additionally, small containers are adapted to allow two smaller containers to form a layer in the stack which includes at least one larger container. The smaller containers are supported at the edges of the large container and reach toward the middle, where they engage one another to form a locked cantilever-style bridge.

11 Claims, 12 Drawing Sheets

STACKABLE/NESTABLE CONTAINERS

This application claims the priority date of Mar. 12, 1994 for U.K. Patent No. 9404833.7.

BACKGROUND TO THE INVENTION

The present invention relates to stackable/nestable containers.

Container systems previously proposed have used various designs of stackable/nestable container. The general form of these containers is open-topped with sides which taper to the base. This taper allows a container to nest in a lower container, and to receive a nesting container from above. Formations such as bale arms, stacking bars or asymmetric ledges are provided around the top of the container to allow containers to be stacked. For instance, stacking bars may be moved out from a stowed position to a position in which they extend across the mouth of the container to support the base of the container stacked above. In any particular system, all of the containers are identical, or very nearly so, in order to allow the containers to be fully interchangeable. In particular, the plan of the container mouth and the container base are virtually identical in all containers, but different container heights may be provided.

It is an object of the invention to provide an improved container system of stackable/nestable containers.

SUMMARY OF THE INVENTION

According to the invention, there is provided a container system comprising a plurality of open-topped containers each adapted to be selectively stackable or nestable with like containers, the system comprising first containers of relatively large plan and second containers of smaller plan, the containers being additionally adapted to allow smaller containers to form a layer in a stack which comprises at least one larger container.

A layer of smaller containers may be formed by two smaller containers. Preferably the containers are adapted to allow a layer of smaller containers to be stacked on a larger container, and to allow a larger container to be stacked on a layer of smaller containers. A layer of smaller containers may be formed by smaller containers which engage each other, the layer being supported on a larger container at support positions, the support positions being insufficient to support a smaller container in the absence of engagement between the smaller containers.

Preferably at least two of the smaller containers have a size, in plan, which is substantially one half of the size, in plan, of the larger containers.

Preferably, the smaller containers are adapted to allow a layer to be formed as aforesaid. Two smaller containers may each be supported at one side thereof by formations provided on a large container, there being engaging formations associated with the smaller containers and which engage to support the other sides of the smaller containers, thereby forming a layer in the stack. The formations provided on the larger containers may be for stacking large containers. The said formations may be surfaces of the smaller containers. The smaller containers may comprise surfaces which abut when two smaller containers are stacked on a larger container. Two complementary forms of surface may be provided on smaller containers, Whereby two smaller containers may be supported when complementary surfaces abut. The smaller containers may have a plurality of surfaces and be asymmetrical to ensure that two surfaces which come together are complementary. The surfaces may comprise complementary recesses and/or projections. The surfaces may be ribbed.

The containers preferably each comprise support members movably mounted thereon, to be movable between a first position which allows a like container to be nested therein, and a second position in which the support members may engage the base of the second like container to support the second container in a stacked condition. The support members may be support bars having an elongate portion which extends across the container when in the second position, and which has terminal portions attached to the container. Each container may comprise locating formations on the underside thereof, the locating formations being so shaped as to locate on the support members of the lower like container when in the second position, to prevent relative horizontal movement of the containers. The locating formations may be grooves or notches for receiving the support members.

The smaller containers may additionally have second locating formations so shaped as to locate on the support members of a lower, larger container. The locating formations and second locating formations may extend generally perpendicular to each other.

Preferably the support members of the smaller containers are formed to engage the locating formations of a larger container stacked thereon, to prevent relative horizontal movement thereof.

The invention also providers a container for the system of any preceding definition.

BRIEF DESCRIPTION OF THE DRAWINGS

Examples of containers embodying the invention will now be described in more detail, by way of example only, and with reference to the accompanying drawings in which:

FIG. 10 is a side elevation of a stacking bar for the small container and.

PREFERRED EMBODIMENTS

Figure 1:
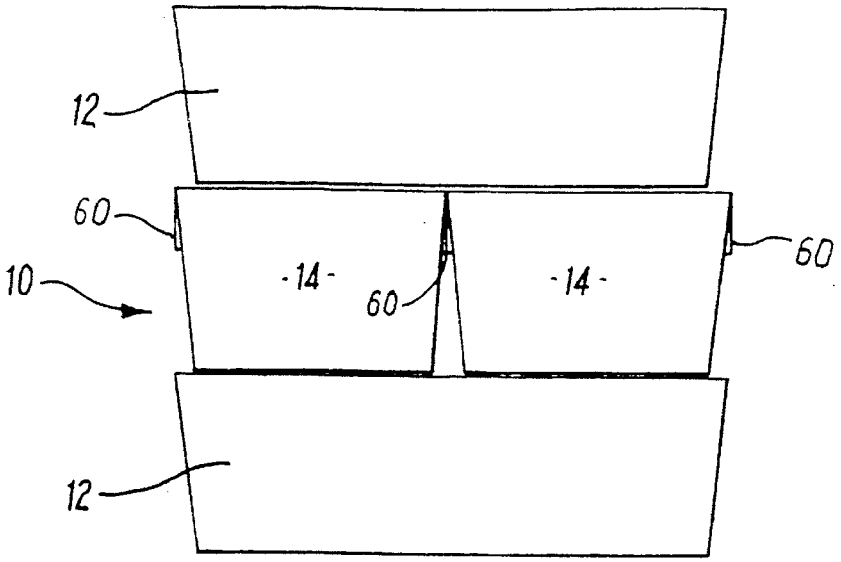
FIG. 1 is a schematic elevation of a stack of containers formed from a container system according to the present invention.
Figure 1A:
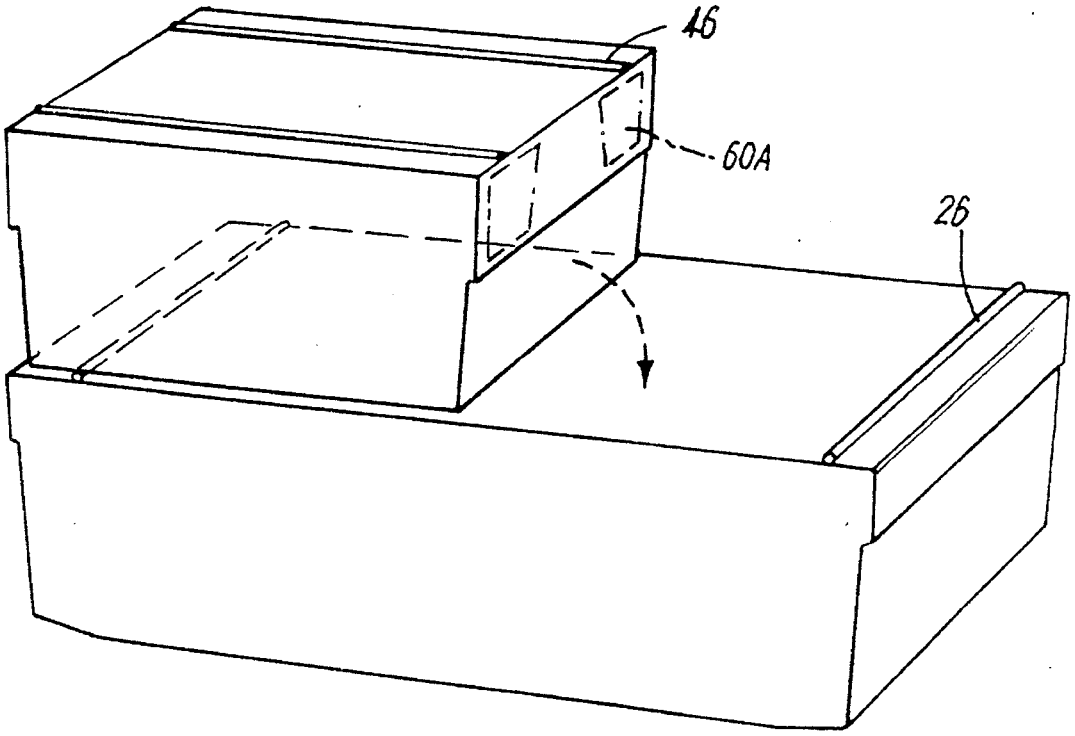
FIG. 1A is perspective view illustrating the inability of a large container to support a single small container in a stacked condition, and showing a direction arrow to indicate the direction of fall of the small container through the open top of the large container.

FIG. 1 shows schematically a stack 10 of containers formed from a container system. The system comprises a plurality of open-topped containers 12, 14 each adapted to be selectively stackable or nestable with like containers. The system comprises first containers 12 of relatively large plan, and second containers 14 of smaller plan. Thus, large containers can stack or nest with large containers. Small containers can stack or nest with small containers. In addition to being stackable and nestable with other smaller containers, the smaller containers are adapted to allow two smaller containers to form a layer in a stack 10 which comprises at least one larger container 12. The stack 10 in FIG. 1 has three layers, the top and lowest layers being formed by the relatively large containers 12, and the middle layer being formed by two smaller containers 14.

For simplicity, the following description will refer to "large" containers and "small" containers but it is to be understood that these terms are being used as relative terms, to distinguish between the two sizes. The actual dimensions of the containers would be chosen according to the intended use.

Figure 2:
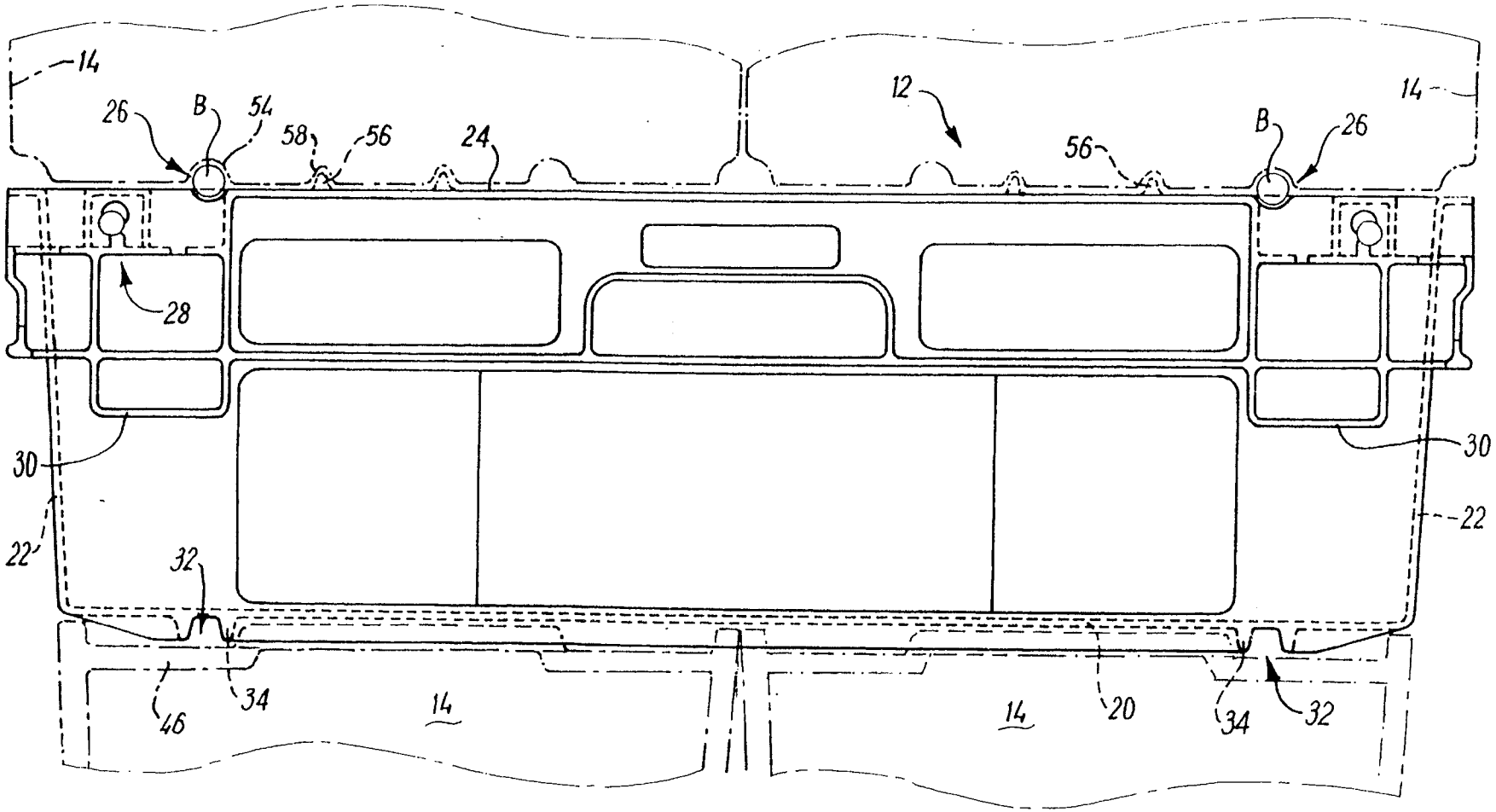
FIG. 2 is a side elevation of a large container.

FIG. 2 shows a large container 12 in side elevation. The container 12 has a base 20 from which four sloping walls 22 extend upwardly to form an open top 24 at the top of the container 12. Two support bars 26 are mounted opposite each other near the top of the walls 22, at a pivotal mounting 28, The details of how they are mounted do not form part of this invention, The mounting allows the bars 26 to adopt either position A or position B. At position A, the bar 26 is clear of the open top 24. This allows a like container to be nested in the container to a depth limited by abutment surfaces 30 formed on each container.

Figure 2A:
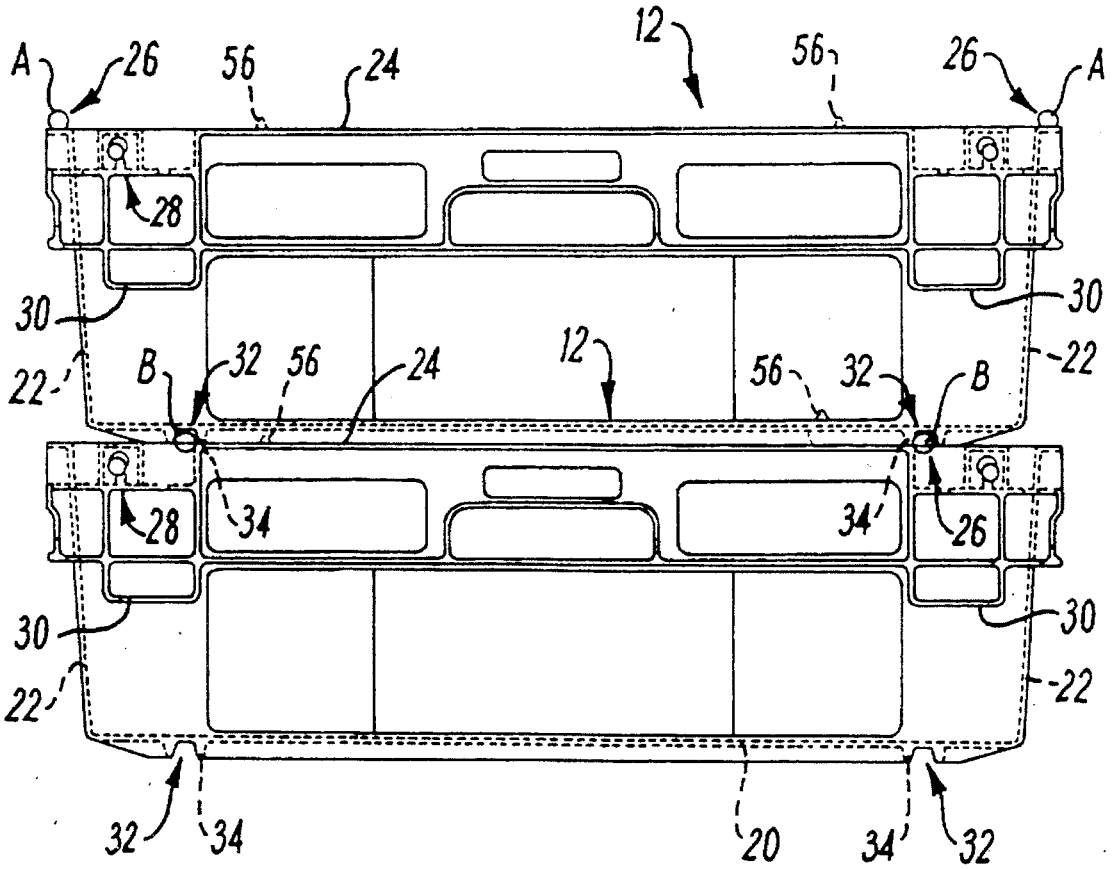
FIG. 2A is a side elevation of two large containers in a stacked condition.

In the second position 8, the elongate portions of the support bars 26 extend across the top of the container 12. This allows another large container to be supported in a stacked condition, as shown in FIG. 2A. Secure stacking is facilitated by providing locating formations 32 at the base 20, directly under position B of the bars 26. The formations 32 consist of channels 34 extending across the base 20 and so shaped as to locate on a support bar 26 of a lower large container when the bar is in position B. This prevents relative horizontal movement of the containers. Other arrangements of grooves, notches and channels could be used. The large containers 12 can be selectively stacked or nested width each other by moving the bars 26 to positions A or B as appropriate, before placing a container on or in another.

Figure 3:
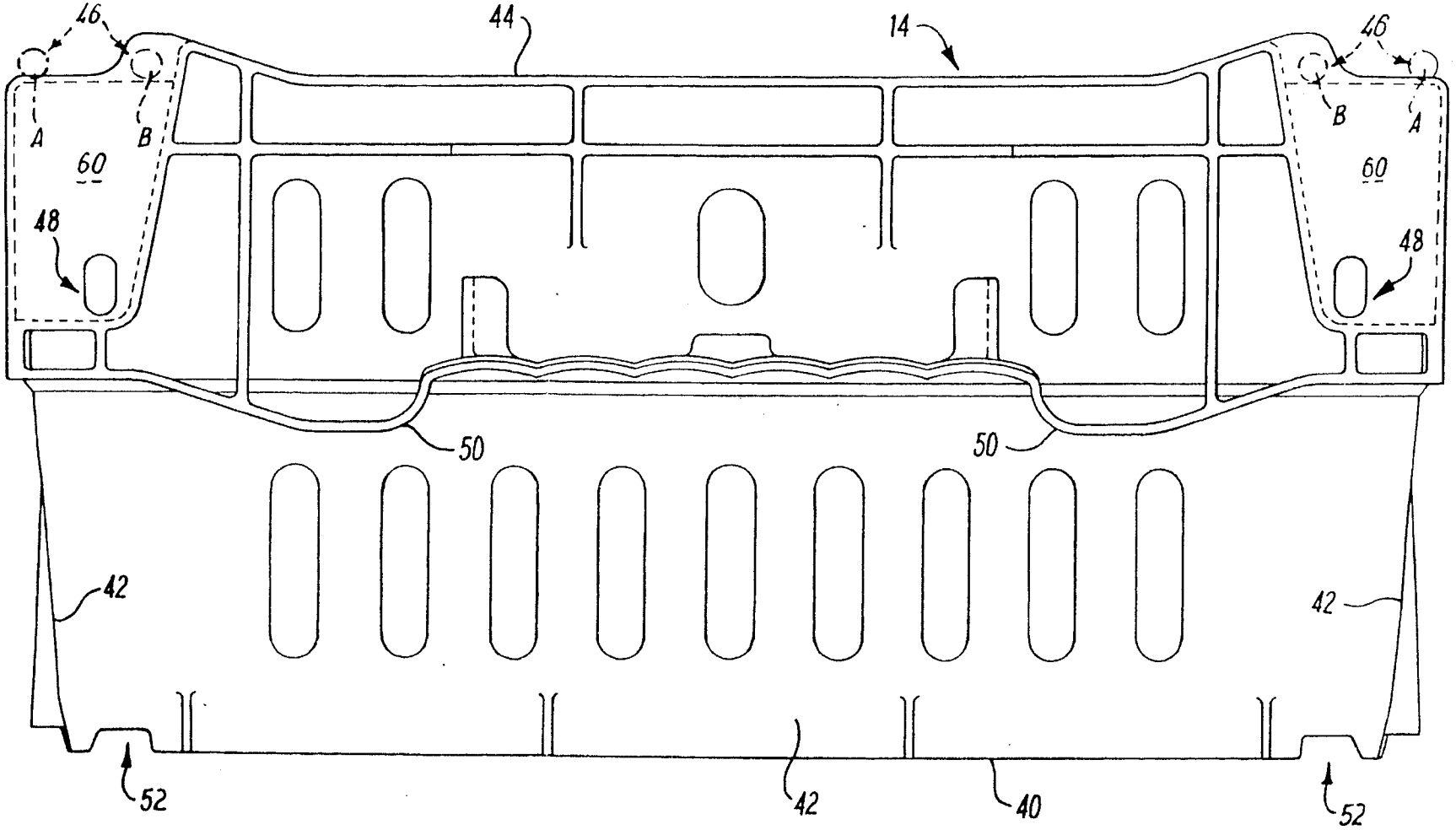
FIG. 3 is a side elevation of a small container.
Figure 4:
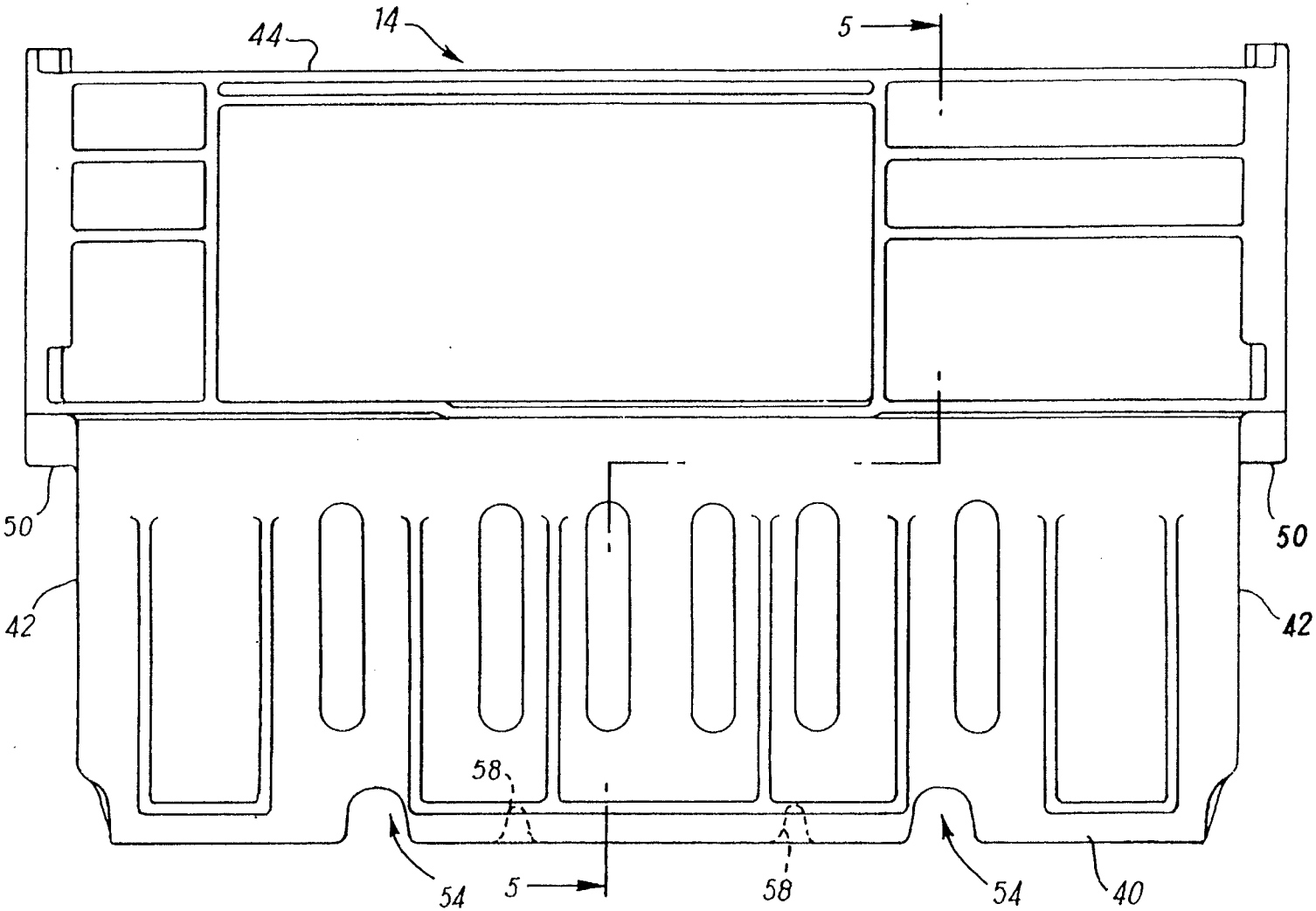
FIG. 4 is an end elevation of the small container.
Figure 5:
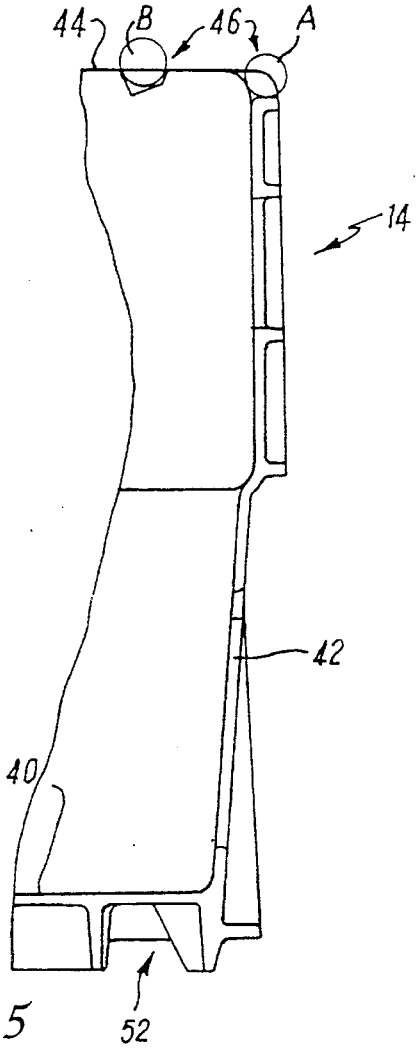
FIG. 5 is a partial vertical section along the line 5—5 of FIG. 4.
Figure 6A:
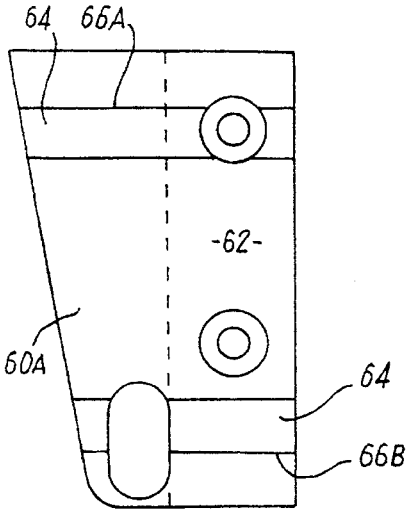
FIGS. 6A, 6B and 6C are side and end elevations, and plan views respectively, of plates for attachment to the small container.
Figure 6B:
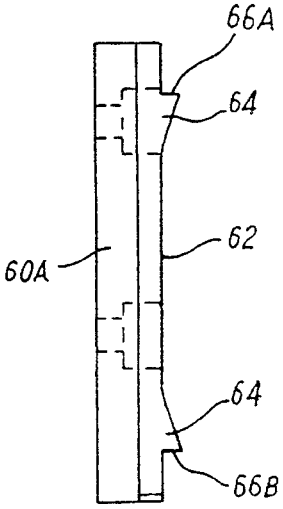
Figure 6C:
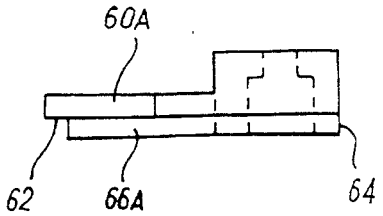
Figure 7A:
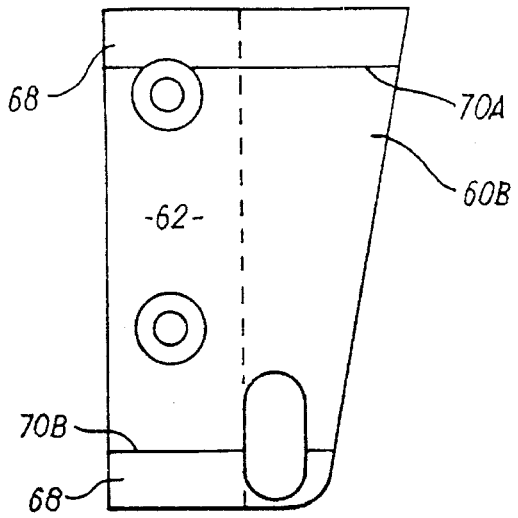
FIGS. 7A, 7B, 7C are views corresponding to FIGS. 6A, 6B and 6C, showing a complementary plate.
Figure 7B:
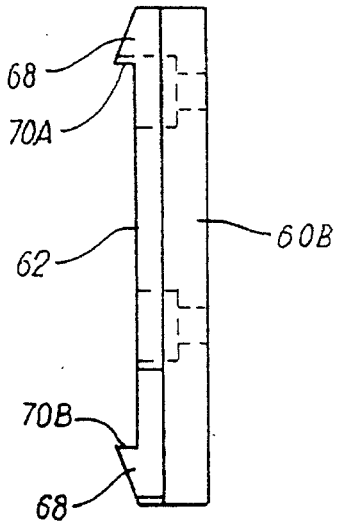
Figure 7C:
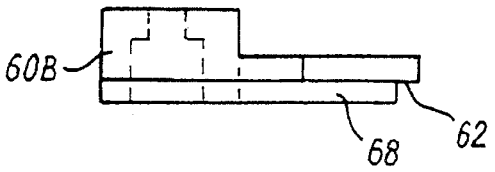
Figure 8A:
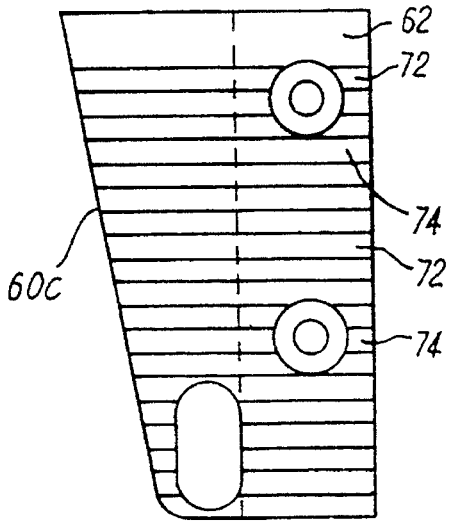
FIGS. 8A, 8B, 8C, 9A, 9B and 9C correspond to FIGS. 6A, 6B, 6C, 7A, 7B and 7C, and show an alternative design of plate.
Figure 8B:
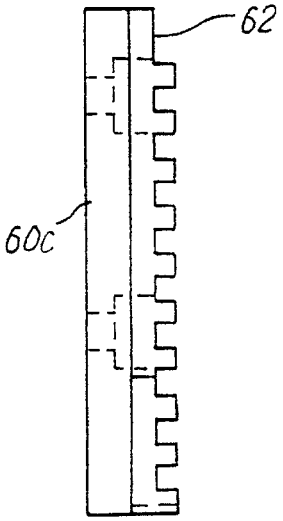
Figure 8C:
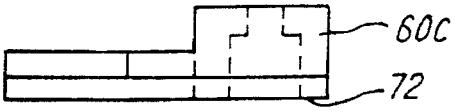
Figure 9A:
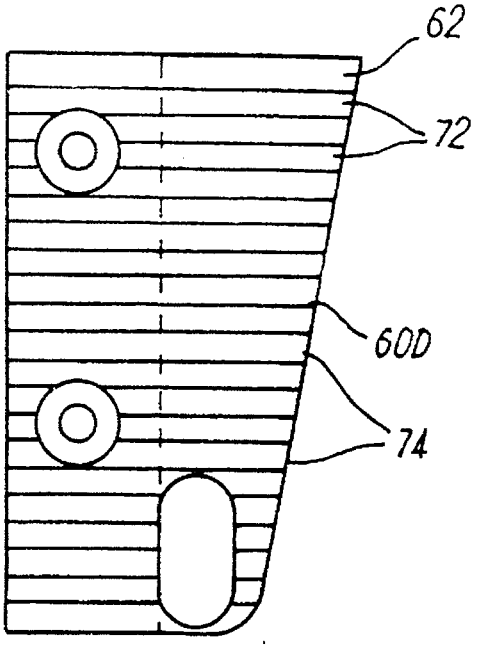
Figure 9B:
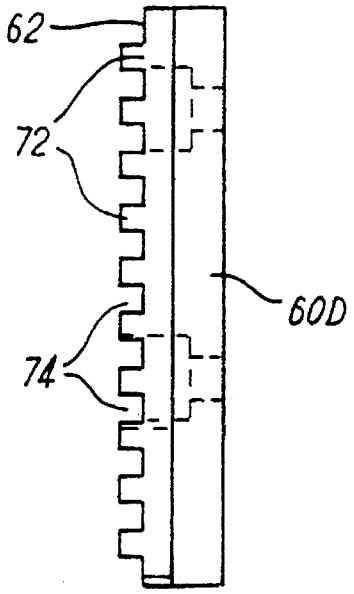
Figure 9C:
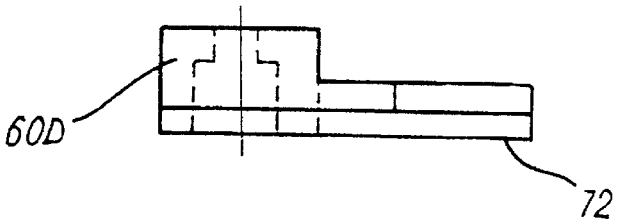

FIGS. 3, 4 and 5 illustrate a small container 14. The small container 14 is approximately half size in plan relative to the large container 12. For instance, the large container may have a rectangular plan of about 600 mm×400 mm, whereas the small container has a rectangular plan of about 300 mm×400 mm. Thus, the plan of two small containers side by side will cover the plan of a large container beneath, but to allow full interworking of the containers in a modular fashion requires further adaptation of the small containers 14, as will now be described.

Figure 3A:
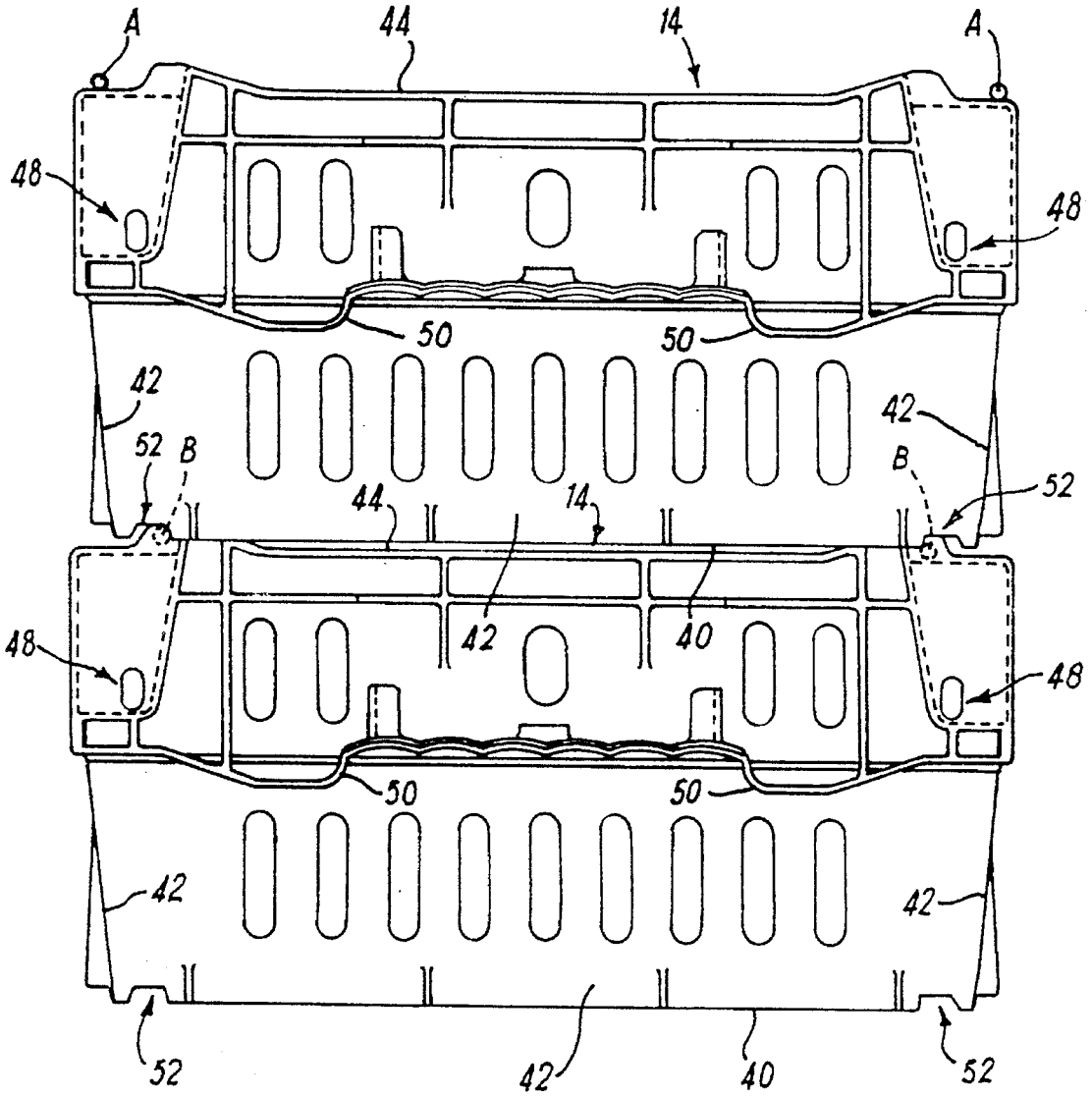
FIG. 3A is a side elevation of two small containers in a stacked condition.

The small containers 14 are generally similar to the large containers 12, in that they have a base 40 from which sloping walls 42 extend up to an open top 44. Support bars 46 have pivotal mountings at 48 to allow them to be moved between first and second positions A, B (best seen in FIG. 5). In position A, the bars 46 are clear of the open top, to allow a second small container to be nested. In the position B, the elongate portion of the support bars 46 extends across the top 44 of the container 14, to engage the base of a second small container to support the container in a stacked condition as shown in FIG. 3A. The maximum depth of nesting is set by abutment surfaces 50. The security of stacking is enhanced by the presence of locating formations 52 in the form of grooves, notches, channels etc. These extend across the base 40 of the container, directly under position B, to receive the bar 46.

In addition, a second set of locating formations 54, again in the form of channels, extend across the base 40, perpendicular to the formations 52.

Small containers can thus be nested or stacked with themselves by selecting the appropriate bar position A, B before placing a small container on or in another small container.

The channels 54 allow a small container 14 to be partly supported in a stacked condition on a large container by locating the channels 54 on the support bars 26 of the large container (when in the "stacking" position B) as indicated in FIG. 2. This supports the small container at one side. Two small containers supported in this manner will meet at the middle of the large container below. To prevent the small containers falling into the large container, as illustrated by the direction arrow in FIG. 1*f* and to enhance the stability when further containers are stacked above, the small containers are further adapted as shown in FIGS. 6 to 9, as will be described below.

Alternatively, or in addition, the large containers 12 may be provided with locating projections 56 at their top edge, with complementary notches 58 being provided at the base of the small containers 14. This would allow a small container to rest on a large container by engagement of the projections 56 and notches 58 (FIG. 2), whatever the position of the stacking bar. The projections and notches could alternatively be formed on the small and large containers, respectively. The projections and notches would preferably be provided in sufficient numbers and/or positions to allow small trays to be reversed while still being able to be supported.

FIGS. 6 to 9 show plates 60A,B,C,D which can be attached to small containers, and have engaging formations formed on their surfaces. (Alternatively, the engaging formations could be formed directly in the walls of the containers 14 as a unitary moulding). Four plates are attached to each small container 14 on the side walls in the region of the mountings 48. The location is indicated in FIG. 3 by broken lines labelled 60. The plates 60A,60B are a pair of designs intended to be used together; the plates 60C,60D are a second pair of designs intended to be used as an alternative arrangement. In each case, two plates 60A (or 60C) are located at diagonally opposite positions on the container 14, while plates 60B (or 60D) are used at the other two corners. This provides asymmetry to the containers 14, so that whenever two containers are stacked on a large container, each container 14 will present one plate 60A (or 60C) and one plate 60B (or 60D) at the middle of the large container. Each plate 60A (or 60C) will be against a plate 60B (or 60D) on the other small container.

Figure 11A:
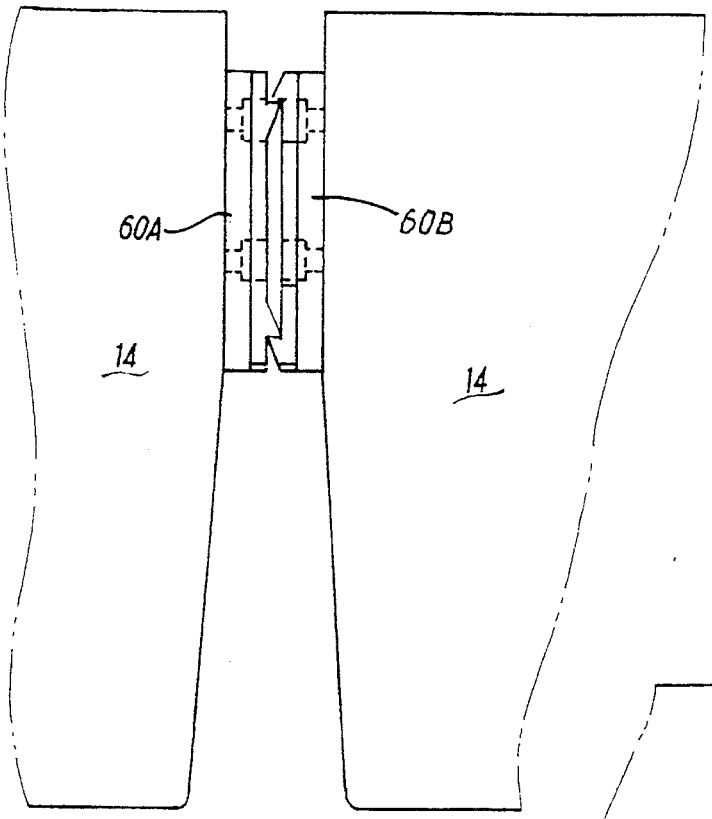
FIGS. 11A and 11B show the plates of FIGS. 6–9 in engagement.

The plates 60A have a generally flat, vertical face 62 on which two ridges 64 are provided. The upper ridge has a flat, horizontal upper face 66A and tapers down to the face 62. The lower ridge has a horizontal lower face 66B and tapers up to the face 62. On the plate 60B, two ridges 68 are formed, the upper ridge having a lower, horizontal face 70A and tapering up to the level of the face 62. The lower ridge 68 has an upper horizontal face 70B and tapers down to the level of the face 62. The separation of the faces 66A,66B is the same as the separation of the faces 70A,70B. Thus, when plates 60A,60B come together during stacking as described above, the ridges 64 sit between and engage the ridges 68 (see FIG. 11A). The complementary nature of these surfaces, and their abutment during stacking provides engagement between the smaller containers. This prevents the plates 60A,60B moving vertically relative to each other. Loads applied to the small containers thus cannot push them down into the larger container or lift them up without sideways movement of the other size of containers, but this is prevented by engagement of the channels 54 with the support bars 26 of the large container. The two small containers thus form a locked cantilever-style bridge over the larger container.

It is envisaged that in practice, it will be necessary to prevent relative vertical movement using complementary formations. However, plane surfaces might function adequately, for instance when loads will be light.

It is preferred to arrange the geometry so that the middle of the large container side walls are not engaged by the small containers above, and remain free to flex in or out. However, an alternative arrangement would provide engagement between each small container and the large container side wall in order to support the small containers mid-way between the support bars of the large container. This arrangement may require modification of the large container side walls, but could dispense with the plates.

Removal of containers from the stack is achieved by lifting the channels 54 off the bars 26. This allows sideways movement of the containers to release the plates 50A,50B.

Figure 11B:
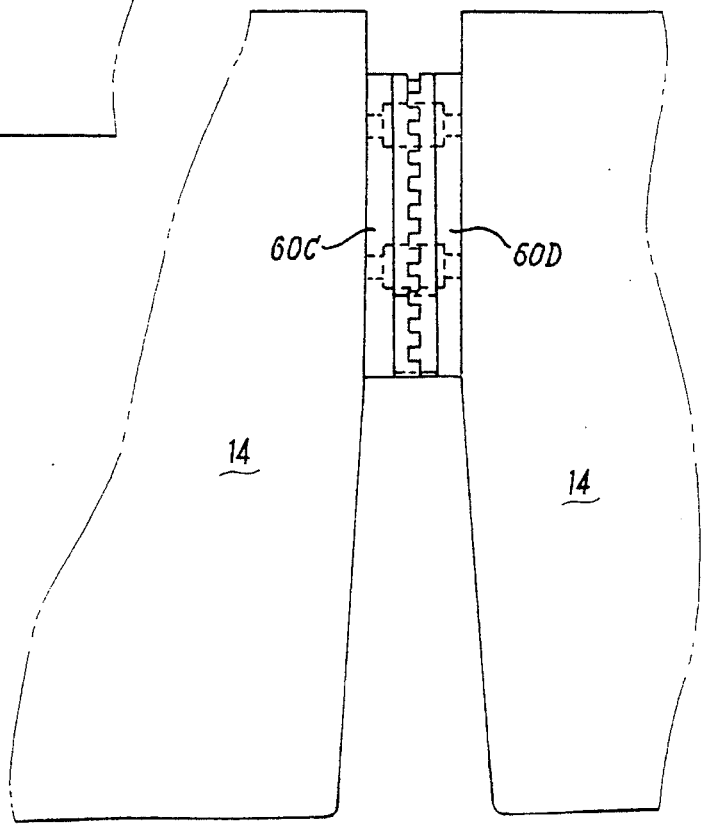

The plates 60C,60D provide a function analogous to that of plates 60A,60B, but have different forms. Both plates 60C,60D have a series of horizontal square-section ribs 72 separated by square-section valleys 74. The positions of the ribs 72 and valleys 74 are chosen so that when the plates 60C,60D come together (as described above in relation to plates 60A,60B) the ribs 72 on one plate fit into the valleys 74 on the other plate (See FIG. 11B). This again secures the small containers against relative vertical movement, to provide the locking effect described above.

Figure 10:
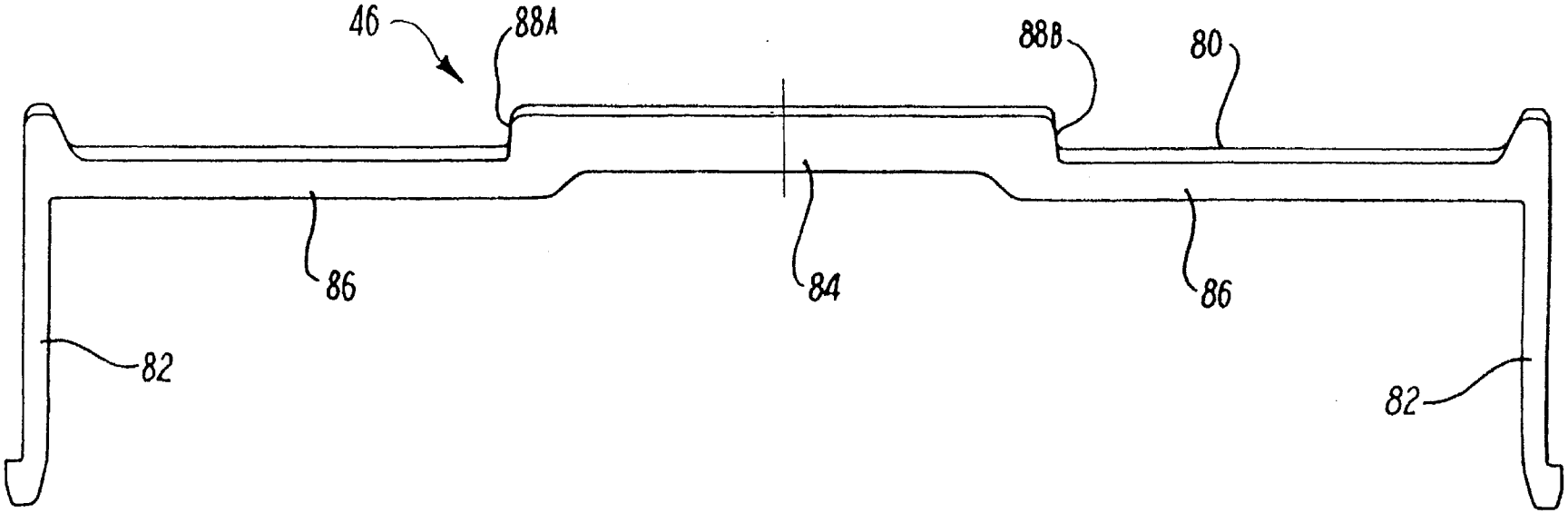

The above description explains how two smaller containers can be stacked on one large container. The small containers are also adapted to allow one large container to stack on two small containers (as shown in FIG. 1). This is effected by the shape of the support bars 46, one of which is shown in FIG. 10 separate from a container 14. The bar 46 has a generally elongate portion 80. It is this portion which extends across the open top when in position B. Terminal portions 82 extend down to the pivotal mountings 48. The portion 80 is divided into three sections of approximately equal length. The mid-section 84 is higher than the end sections 86 and is joined to the end sections 86 by sloping abutment surfaces 88A,88B. The separation of the abutment surface 88A from the nearest wall on which the bar 46 is mounted is chosen such: that when a large container is stacked on the bar 46, with outer walls in alignment with the small container below, the surface 88A abuts the outer surface of the channel 34 to prevent the large container sliding to the right (as seen in FIGS. 2 and 10). The large container would then extend beyond the right side (as seen in FIGS. 2 and 10) of the small container. Similarly, a large container could be supported on the bar 46 with the surface 88B abutting the outer surface of a channel 34 to prevent a large container sliding to the left (as seen in FIGS. 2 and 10), in which case the large container would extend beyond the left side of the small container.

Thus, when two small containers are side by side, with their bars 46 parallel and aligned, and all four bars 46 in position B, a large container can be securely stacked on two small containers. Two surfaces 88A, and two surfaces 88B secure the large container against horizontal movement.

Stacking one large container onto two small containers is further facilitated by the profile of the top of the wall of the small container, as seen in FIG. 3. It can be seen that the top of the wall rises slightly in the region of the bars 46. This provides a guide surface over which the lower surface of a large container can slide without engaging the bars 46 on the small containers below. This reduces the risk of containers being damaged or misaligned, for instance as a result of careless handling.

The arrangements described above thus provide a system in which containers can be stacked, each layer of the stack being chosen to be either one large container or two small containers. The stability of the stack is unaffected by this choice, and the choice at any level is not affected by the choice at the level below or above. Empty large or small containers can be nested with other empty large or small containers respectively.

A particular advantage of the arrangement as described is that appropriately designed small containers can be supplied subsequently for use with existing large containers to be used as described above, but without requiring any modification of the large containers.

Many variations and modifications can be made to the apparatus described above, without departing from the scope of the invention. Many different formations for engaging containers with each other can be devised. The small containers have been described as half size relative to the large containers but it is expected that other alternatives could be devised, i.e. in which the small containers meet at a position other than mid-way across the large container below. This might provide a system having three or more sizes of container.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A container system comprising:

(a) a large container having an open top, attached side walls, and a base, said large container forming a first container layer of said container system;

(b) a plurality of small containers each having attached side walls and a base, said plurality of small containers being arranged side by side over the open top of said large container to bridge the distance between an opposing two of the side walls of said large container of the first container layer and to collectively form a second container layer carried by said first container layer;

(c) first and second support members located respectively adjacent to the opposing side walls of said large container for supporting opposite ends of the second container layer on the first container layer in a stacked condition; and (d) said small containers of the second container layer having respective outwardly-projecting side exterior surface areas which engage each other, and which cooperate to brace an interior of the second container layer over the open top of said large container of the first container layer, thereby preventing the second container layer from collapsing downwardly through the open top of said large container of the first container layer.

2. The system of claim 1, wherein the base of said large container is adapted for engaging the small containers of the second container layer such that said large container is stackable on a layer of small containers.

3. The system of claim 1, wherein the support members of the large container comprise respective elongated, adjustable bars.

4. The system of claim 3, wherein each small container of the second container layer has at least one locating formation formed on its underside for mating with the support bar of the large container.

5. The system of claim 1, wherein the large container is adapted for being supported by the support members of a like large container such that the large containers are stackable on like large containers.

6. The system of claim 1, wherein said large containers and said small containers each comprise support members movably mounted thereon to be movable between a first position which allows a like container to be nested therein, and a second position in which the support members engage the base of said like container to support said like container in a stacked condition.

7. The system of claim 6, wherein each of said large and small containers comprises locating formations on the underside thereof, said locating formations being engageable with said support members of a lower like container when said support members are in said second position, said engagement preventing relative horizontal movement of said containers.

8. The system of claim 7, wherein said locating formations comprise one of the set of grooves and notches, said locating formations receiving said support members in the second position.

9. The system of claim 7, wherein said small containers additionally have second locating formations engageable with the support members of a lower, large container.

10. The system of claim 9, wherein said first and second locating formations of each small container extend generally perpendicular to each other.

11. The system of claim 7, wherein said support members of said small containers are movable to engage said locating formations of a large container stacked thereon to prevent relative horizontal movement thereof of said large container relative to said small containers.

* * * * *